United States Patent [19]

Tippett

[11] 4,111,582

[45] Sep. 5, 1978

[54] EXPANSION JOINT

[76] Inventor: Samuel Tippett, 11 St. Michael's Ct., Monkton Combe, Bath, Somerset, England

[21] Appl. No.: 828,813

[22] Filed: Aug. 29, 1977

Related U.S. Application Data

[63] Continuation of Ser. No. 668,526, Mar. 19, 1976, abandoned.

[51] Int. Cl.[2] ..... E01C 11/02

[52] U.S. Cl. ..... 404/47; 14/16.5; 52/396

[58] Field of Search ..... 404/47, 48, 68, 69, 404/65; 52/396; 14/16.5

[56] References Cited

U.S. PATENT DOCUMENTS

| | | | |
|---|---|---|---|
| 1,637,480 | 8/1927 | Gage | 404/47 |
| 2,282,335 | 5/1942 | Methven | 404/48 |
| 2,619,884 | 12/1952 | Jacobson | 404/65 |
| 3,135,176 | 6/1964 | Foulger | 404/47 |
| 3,316,574 | 5/1967 | Pare | 404/47 X |
| 3,474,625 | 10/1969 | Draper | 404/47 X |
| 3,583,120 | 6/1971 | Wangerow | 404/68 X |
| 3,808,762 | 5/1974 | Hurst | 404/65 |
| 3,813,180 | 5/1974 | O'Brill | 404/65 X |

FOREIGN PATENT DOCUMENTS

| | | | |
|---|---|---|---|
| 241,514 | 7/1965 | Austria | 404/68 |
| 1,409,032 | 11/1968 | Fed. Rep. of Germany | 404/69 |
| 2,330,640 | 1/1974 | Fed. Rep. of Germany | 404/68 |
| 1,354,774 | 5/1974 | United Kingdom | 404/68 |

*Primary Examiner*—Nile C. Byers

*Attorney, Agent, or Firm*—Pennie & Edmonds

[57] ABSTRACT

A buried expansion joint for bridges and the like has an elastomeric member having areas of increased compressibility towards each edge, and integral flanges at each edge for securing to bridge deck parts. The bridging member with its flanges is a continuous, constant cross-section, extrusion and is cut either in the factory, or on site, to lengths corresponding to the width of the bridge roadway.

5 Claims, 8 Drawing Figures

EXPANSION JOINT

This is a continuation of application Ser. No. 668,526, filed Mar. 19, 1976, now abandoned.

FIELD OF THE INVENTION

This invention relates to buried expansion joints for roadways on the decks of e.g. bridges or viaducts.

BACKGROUND OF THE INVENTION

In the construction of such roadways a deck is laid discontinuously with openings running across the roadway to permit movement between adjacent parts of the bridge. These movements can involve considerable displacements longitudinally of the roadway due to expansion and contraction of the bridge, and also can involve a flexing or bending at the joint. Their effect on the upper layers of the roadway must be reduced as much as possible to preserve these continuous upper layers from unnecessary movement and their subsequent deterioration, and this, as well bridging the gaps formed by the discontinuities in the deck, is the function of an expansion joint.

The expansion joint is laid on top of the deck to bridge the opening between adjacent decks. In addition to absorbing the forces between the deck parts due to expansion of those deck parts without being damaged by these forces or transmitting them harmfully to either the roadway surface or the supporting deck part, buried expansion joints should provide an adequate seal against surface water and debris penetrating the openings between the decks of the bridge.

Ideally, buried bridge expansion joints should:

(a) provide a safe smooth ride for vehicles over the joint;

(b) be capable of absorbing impact forces without transmitting these forces harmfully to the bridge decks and roadway surface, (c) be capable of supporting the heaviest traffic loads over the joint without unacceptable vertical deflection of the roadway surface, thereby providing a durable fracture free wearing surface to the road over the expansion joint, (d) be capable of accommodating at low stress values all the horizontal and skew movements that will be experienced by the bridge decks for which the expansion joint is designed, (e) be capable of accommodating deck rotations without severe road surface deflection, (f) be easy to install and be capable of accommodating a degree of misalignment between the adjacent decks, (g) be capable of providing a durable and effective seal throughout the bridge joint, to thereby prevent the penetration of surface water and debris through the joint, and consequently eliminate the necessity of supplementary drain systems under the expansion joint.

Over the past years many designs of buried expansion joints have been applied to accommodate the movements that occur in civil engineering structures, but practically all have failed to be satisfactory either from the point of view of durability or of ease of laying or both. A buried expansion joint which consisted of a metallic plate laid over the gap has particularly proved unsatisfactory as requiring great accuracy in laying (otherwise it will rock) and as being unable to accommodate the torsional forces which occur between adjacent deck parts during passage of vehicles. A buried expansion joint of very stiff elastomeric material comprising an elongated main portion generally rectangular in cross-section and consisting of a central bridging portion integral with a pair of lateral side limbs which are divided from the bridging portion by longitudinally extending voids and/or cavities which permit lateral expansion or contraction of the bridging portion to accommodate relative displacement of the roadway sections is disclosed in German patent application No. P25 20 521.4. The expansion joint disclosed in P25 20 521.4 includes a flashing, also of rubber, which extends over the upper surface of the elongated main portion, down its sides and along the surfaces of the decking adjacent the main portion to which it is attached by layers of adhesive bedding.

The flashing caters for tension movements and also provides a waterproof cover over the extension gap.

A debonding layer of aluminium faced sheet is laid above the expansion joint and extends for some distance on either side thereof to spread any extension over a considerable length of the surfacing. Buried expansion joints are assembled as they are laid and a construction, such as disclosed in P25 20 541.4 involving the separate positioning and securing of flashing and main portion, takes considerable time, and hence expense, to lay. The separate manufacture of two distinct elements also involves a cost disadvantage.

SUMMARY OF THE INVENTION

An object of the present invention is to provide a buried expansion joint which is simple to manufacture, reliable and predictable in its properties, and virtually foolproof from the point of view of correct positioning.

A further object of the invention is to provide a buried expansion joint of unitary one piece construction which is formed as a single extrusion of elastomeric material.

A yet further object is to provide a buried expansion joint in which the securing in place of the joint member and of its protective seal is a single operation.

In the invention, a buried expansion joint member of very stiff elastomeric material, having towards each edge a region of increased lateral compressibility has at each said edge an integrally formed flange of the elastomeric material, respective flanges being bonded to respective deck parts the gap between which is bridged by the elastomeric member. The flanges are to lie in substantially the same plane as the base of the member, and may extend direct from the lower corner of the edge of the member or, preferably, may have a connecting portion which, extending substantially perpendicular to the said plane, links the flange to the upper corner of the edge of the member. For improved keying with the road stratum in which they are buried, the flanges have at least one protrusion on their upper surface.

The region of increased lateral compressibility (which, when the member is laid in the lateral direction of a roadway, allows for longitudinal displacements of the deck parts) is provided by voids and/or channels in the member. These are readily formed by an extrusion process. The cavities and/or channels formed in the main portion are dimensioned such that the total volume of elastomeric material displaced by the cavities and/or channels equals or preferably exceeds the volume of elastomeric material that would be displaced when the edges are displaced towards each other by the maximum horizontal movement occuring when the adjacent roadway sections have expanded towards each other at the maximum temperature to which the roadway will be subjected in practice.

The very stiff elastomeric material from which the joint is made preferably has a hardness of 60° to 85° on the Shore A Scale. It may for example be a natural or synthetic rubber, nylon, polyvinyl-chloride, or a cross linked copolymer, for example acrylo-nitrile-butadiene-styrene. One example of the material is a chloroprene rubber compound possessing a hardness of 80° to 85° Shore A Scale.

The joint may be formed as module sections by moulding, or preferably formed by an extruding process followed by vulcanisation, to a continuous length up to 66 feet (20 meters) or more, as this method will eliminate the necessity of multiple joints across the roadway width.

DESCRIPTION OF THE DRAWINGS AND OF PREFERRED EMBODIMENTS

Buried expansion joints according to this invention will now be described by way of example with reference to the accompanying drawings in which.

Figure 1:
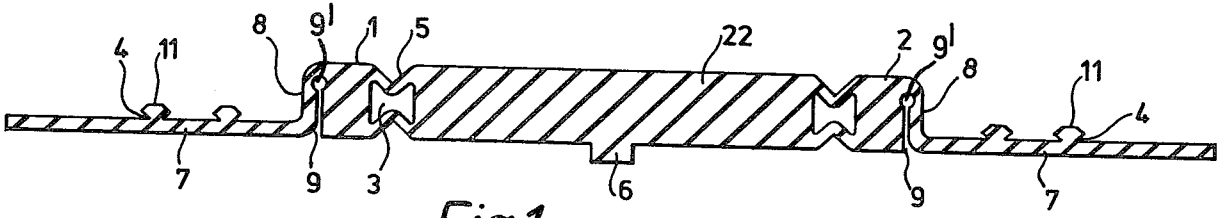
FIG. 1 is a cross-section of a joint made of very stiff elastomeric material.

FIG. 1 is a cross-section of a joint which is at present the most preferred embodiment of this invention. It is made from Neoprene having a hardness of 80° to 85° on the Shore A Scale. It comprises a main portion generally rectangular in cross-section formed of a bridging piece 22 and a pair of edge portions 1 and 2 divided from the bridging piece by a region of increased compressibility, defined by a cavity 3 and recesses or channels 5 adjacent to, and longitudinally parallel with each edge portion 1 and 2. The bridging piece 22 has an elongated protrusion 6 projecting vertically downwards from its lower surface and positioned symmetrically between the edge portions and parallel with them. The joint also includes a pair of thin lateral flanges 7 each of which is joined to the edge portions by a connection portion 8 adjacent the upper surface of the edge portion. The connection portions extend parallel to the edge portions and there is a narrow gap 9, with an enlarged end 9', between each edge portion and the associated connection portion. Each flange 7 extends laterally of the associated edge portion and is coplanar with the bottom surface thereof. Each flange is provided on its upper surface with keying protrusions 11 having undercuts 4, and the protrusions extend for the whole length of the joint and parallel with the channels 5.

The gaps 9 permit some relative lateral movement between each flange and the associated edge portion but their main purpose is to allow the flanges to be rolled back without difficulty during installation.

The joint is preferably a one-piece integral extrusion, of constant cross-section.

Figure 2:
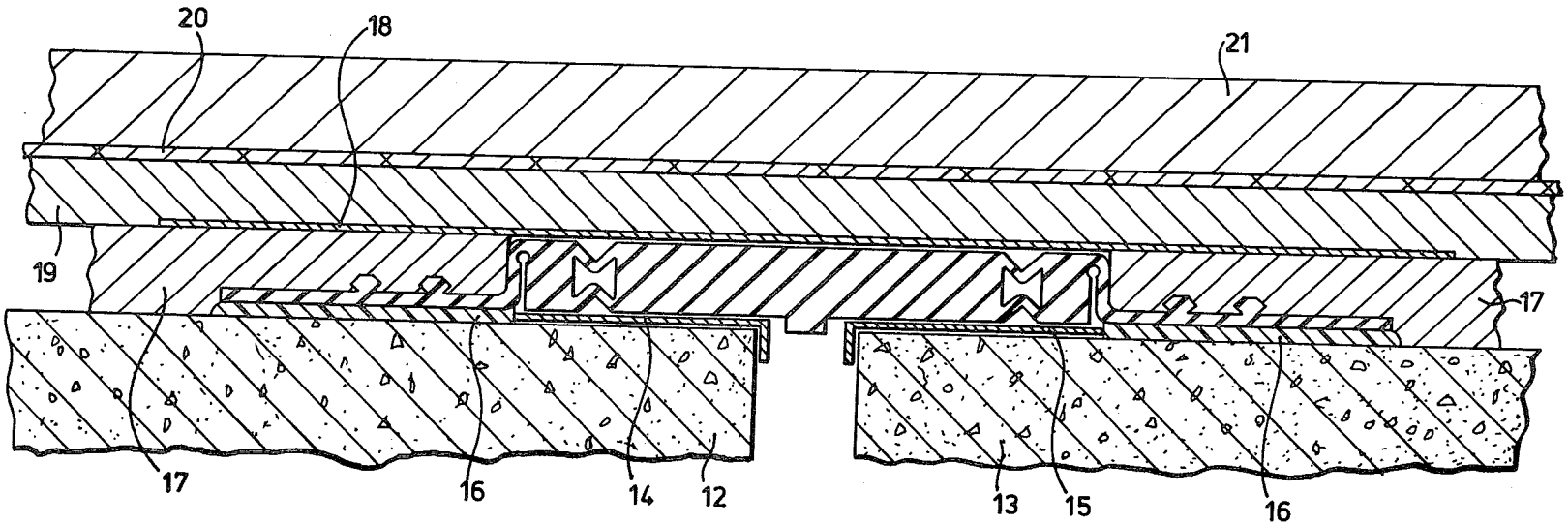
FIG. 2 is a cross-section of a buried bridge expansion joint assembly according to this invention including part section of adjacent decks of the bridge and other components and road surfacing materials. This Figure illustrates the installed condition of the joint when the opening between decks is at mid working temperature expansion.

FIG. 2 is a cross-section of a buried bridge expansion joint assembly according to this invention, and includes a part cross-section of materials and road surfacing layers applied, to illustrate one manner in which the complete installation may be carried out to achieve a durable and efficient junction between roadway deck parts.

In this figure the cross-section illustrates the as manufactured form of the joint installed on the bridge deck parts 12 and 12 when the opening between deck parts is at mid-temperature expansion.

The installation in a bridge of an expansion joint according to this invention may be carried out in the following manner, as shown in FIG. 2:

Isolating or debonding strips 14 and 15 are stuck onto the deck parts 12 and 13. The isolating strips 14 and 15 may be formed from adhesive backed aluminium foil, the foil surface upwards. The joint shown in FIG. 1 is laid, preferably in a length such that there are no joins in the width of the roadway, on the isolating strips 14 and 15 and positioned so that it is symmetrically spanning the opening between deck parts 12 and 13. A collapsible filler strip formed to fit the opening between the deck parts and grooved to accept the protrusion 6 may be used to locate the joint accurately.

The flanges at each side are lifted or folded back to be clear of the deck part surfaces, and a waterproofing adhesive layer 16 is applied to the appropriate areas of the deck part surfaces. The flanges are then lowered and the lower surfaces of the horizontal portion 10 of the flanges 7 are stuck securely to the deck-part surfaces with the water-proofing adhesive 16. It can be seen that the position of the flanges is uniquely and positively determined by the position of the bridging portion of the elastomeric member. Then a mastic asphalt layer 17 is applied to the bridge deck parts 12 and 13 and over the flanges 7 up to the level of the top surfaces of the bridging piece 22. A width of isolating or debonding material 18 is positioned symmetrically in relation to the expansion joint and stuck to the upper surface of the joint and the surface of the mastic asphalt layer 17. The isolating material 18 may be adhesive backed aluminium foil.

The layers of isolating material allow the bridging piece to move freely relative to the road surfacing layers and the bridge decks in response to expansion and contraction of the bridge decks.

The bitumenous regulating or base course 19 is applied over the isolating material 18 and the mastic asphalt layer 17 to a depth thickness of 1 inch approximately, sheets of open mesh expanded metal 20 are embedded near the upper surface of the bitumenous regulating or base course 19, achieved by applying the expanded metal 20, whilst the bitumenous material is still hot.

Finally when the regulating or base course 19 is thoroughly cooled the bitumenous wearing course 21 is applied over the whole to a thickness of 1⅜ inches or of a thickness to conform to road surface level.

Figure 3:
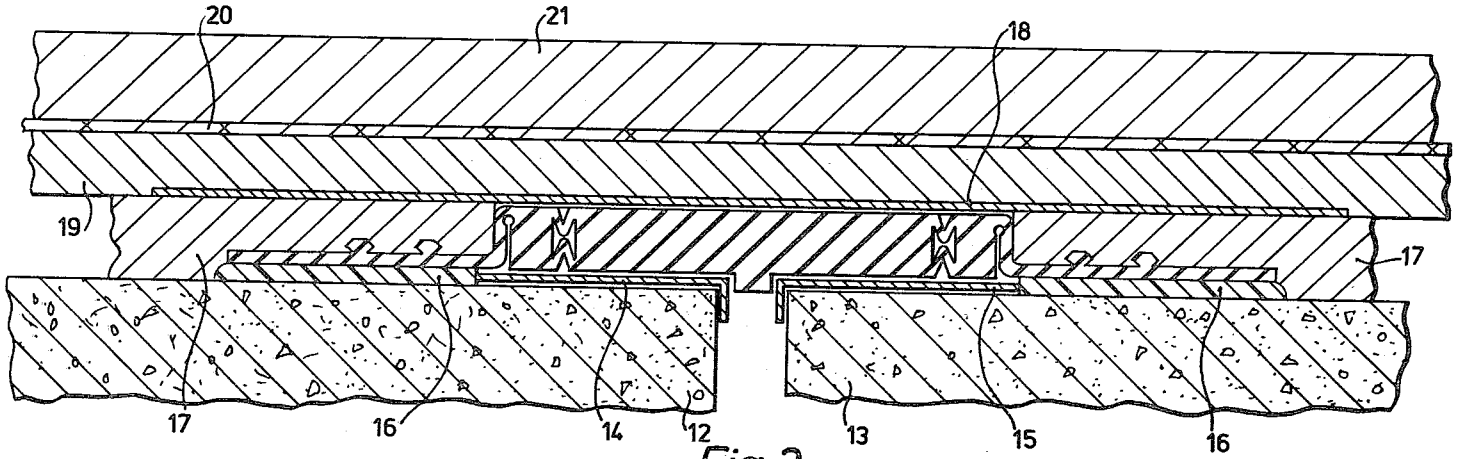
FIG. 3 is a cross-section of a buried bridge expansion joint assembly as described in FIG. 2 but illustrating the closure of the voids and/or recesses or channels when the bridge decks move horizontally towards each other from mid temperature expansion to maximum working temperature expansion.
Figure 4:
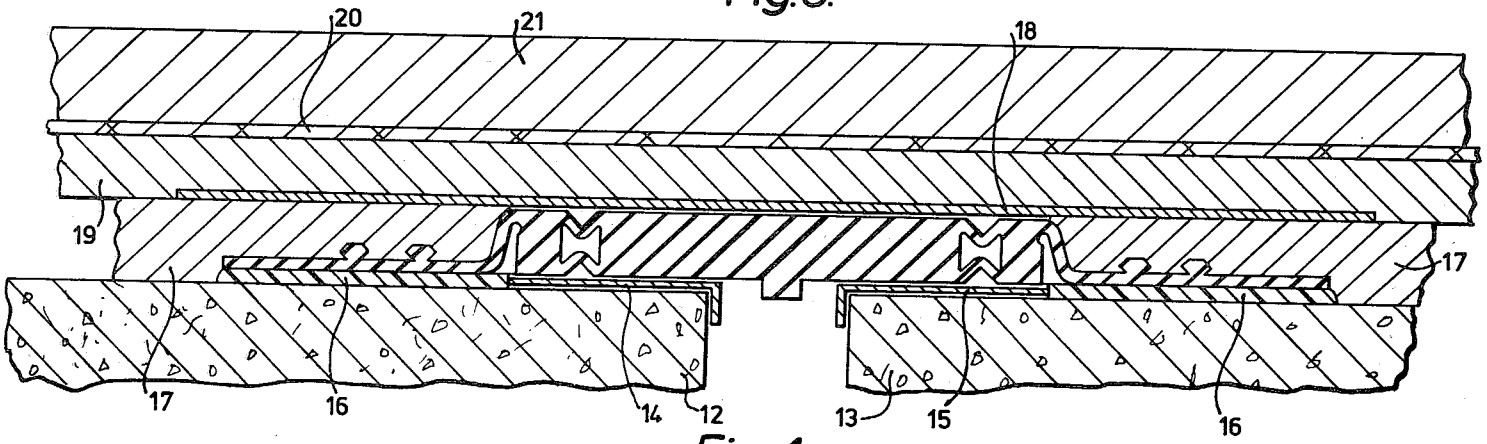
FIG. 4 is a cross-section of a buried bridge expansion joint assembly as described for FIG. 2 but illustrating that the voids and/or recesses or channels return to their original form and thereafter the vertical portions of the flanges are tensioned outwards when the decks of the bridge move away from each other due to their contraction when the temperature falls below mid working temperature.
Figure 5:
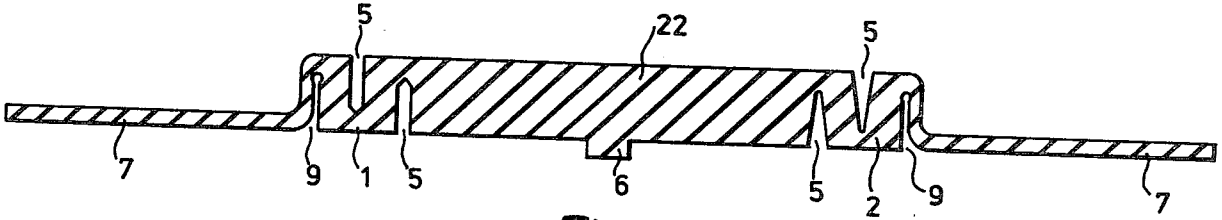
FIG. 5 shows in cross-section another joint according to this invention.
Figure 6:
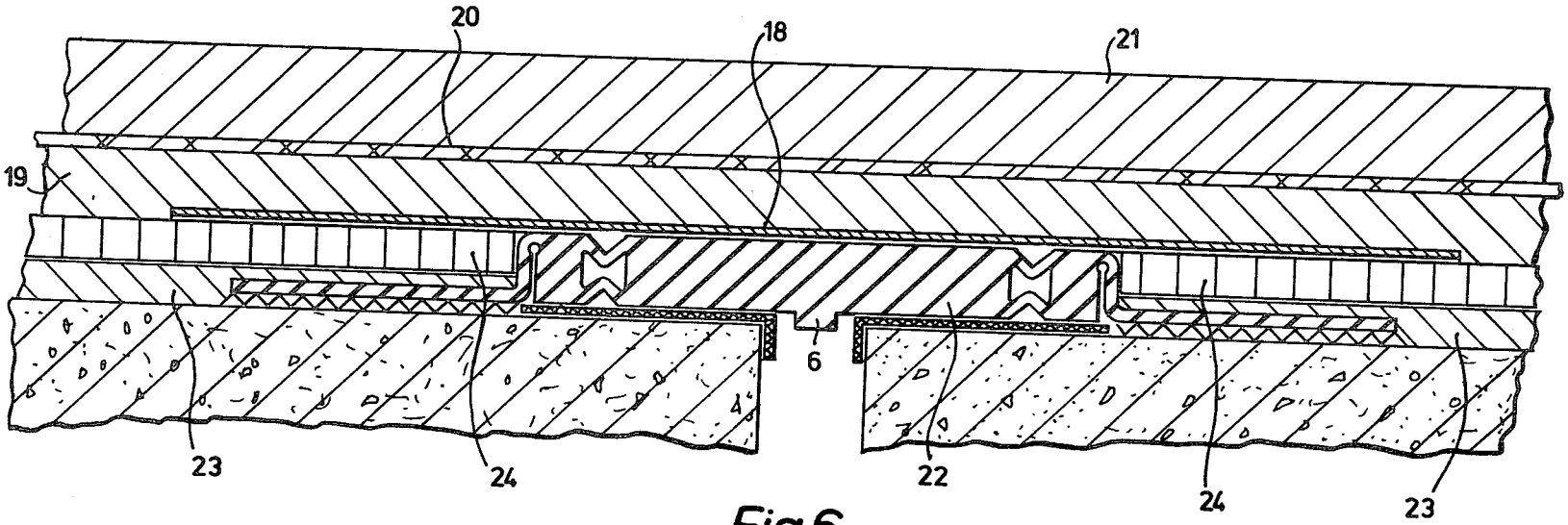
FIG. 6 shows in cross-section yet another joint according to the invention in situ.

The joint shown in FIG. 3 is similar to the one shown in FIG. 1, except that no cavitites are present and the channels 5 are made considerably deeper so as to accommodate all of the anticipated expansion and contraction movements. In addition, no projections are present on the upper surfaces of the flanges, to enable the joint to be installed as shown in FIG. 6. In FIG. 6 an expansion joint similar to the one shown in FIG. 1 is shown installed in a roadway, but, like the joint of FIG. 5, it has no projections on the flanges. This enables it to be installed as shown, with a conventional deck waterproofing layer 23 (e.g. rubberised bitumen, or a heavy-duty bitu-thene membrane) and a conventional preformed waterproofing membrane 23 (e.g. moulded or cast rubberised bitumen deck slabs or asphalt and sand carpet) replacing the mastic asphalt layer 17. In this type of installation projections on the flange are unnecessary and would project above the waterproofing layer 23.

Figure 7:
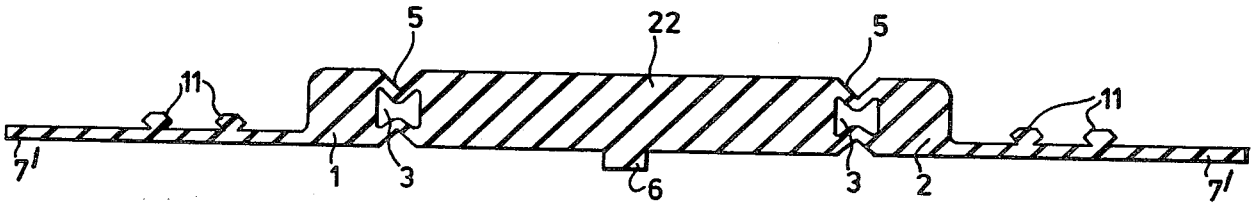
FIGS. 7 and 8 show in cross-section further joints according to the invention.
Figure 8:
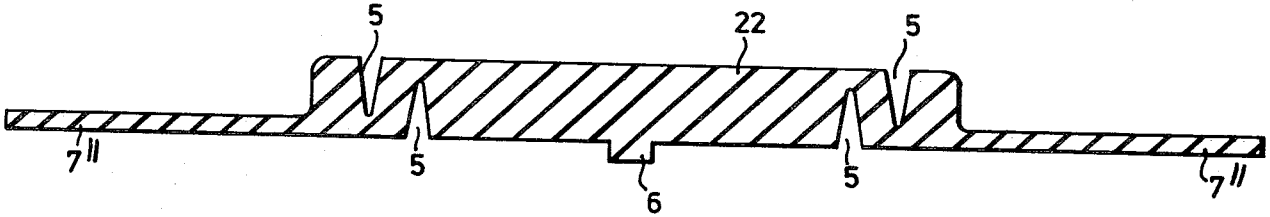

FIGS. 7 and 8 show other joints according to the invention which differ from those already illustrated in that respective flanges 7', 7'' joined directly to the lower part of the respective edge.

I claim:

1. An expansion joint buried in a roadway and bridging a gap between adjacent deck parts of a civil engineering structure the roadway consisting essentially of a plurality of strata and the expansion joint being buried in at least one of said strata and at least one of said strata being continuous over the said expansion joint, the expansion joint including an elongate elastomeric joint member disposed transversely across the roadway, said joint member consisting essentially of elastomeric material and having a body and flange parts, the body having a lower surface which is supported at respective sides of a median plane on respective deck parts whereby a central portion of the body spans the gap between the deck parts, a debonding layer between said lower surface and said deck parts, said flange parts being secured in watertight manner to the respective deck parts at each lateral side of the body whereby to form with the body a continuous waterproof roof over the gap, the body and the flange parts being formed in an integral one-piece whole of the elastomeric material, and edge portions of the body being separated from the central portion thereof by regions of the body of greater lateral compressibility than that of the edge portions and the central portion.

2. An expansion joint as claimed in claim 1 comprising on the upper surfaces of each flange part, at least one keying protrusion engaging the material of one of the strata of the roadway.

3. An expansion joint as claimed in claim 1 wherein the body and flange parts are an integral one-piece extrusion and have a hardness of 60° to 85°, Shore A.

4. An expansion joint as claimed in claim 3 wherein the length of the extrusion is at least as great as the width of the roadway.

5. An expansion joint as claimed in claim 1 wherein the expansion joint is overlaid by a debonding layer between its upper surface and a next upper stratum of the roadway, the lateral extension of the said layer being greater than that of the body.

* * * * *